US008796947B2

(12) United States Patent
Chen

(10) Patent No.: US 8,796,947 B2
(45) Date of Patent: Aug. 5, 2014

(54) LIGHT SOURCE DRIVING DEVICE

(75) Inventor: Yi-Chuan Chen, New Taipei (TW)

(73) Assignee: Vivotek Inc., New Taipei (TW)

( * ) Notice: Subject to any disclaimer, the term of this patent is extended or adjusted under 35 U.S.C. 154(b) by 441 days.

(21) Appl. No.: 13/337,389

(22) Filed: Dec. 27, 2011

(65) Prior Publication Data

US 2013/0099680 A1 Apr. 25, 2013

(30) Foreign Application Priority Data

Oct. 21, 2011 (TW) ..... 100138270 A

(51) Int. Cl.
*H05B 37/02* (2006.01)
*H05B 37/00* (2006.01)

(52) U.S. Cl.
CPC ..... *H05B 37/00* (2013.01)
USPC ..... 315/291

(58) Field of Classification Search
USPC ..... 315/291
See application file for complete search history.

(56) References Cited

U.S. PATENT DOCUMENTS 7,855,520 B2 * 12/2010 Leng ..... 315/307
7,928,670 B2 * 4/2011 Chen et al. ..... 315/308
8,471,497 B2 * 6/2013 Ruan et al. ..... 315/307
2007/0075653 A1 4/2007 Nishinosono
2010/0060187 A1 3/2010 Newman, Jr. et al.
2011/0007282 A1 1/2011 Huang et al.
2011/0018450 A1 1/2011 Hsu et al.

FOREIGN PATENT DOCUMENTS

TW 201103374 A 1/2011
TW 201105168 A 2/2011

OTHER PUBLICATIONS

Taiwan Office Action dated Mar. 12, 2014 in application No. 100138270. (partial English translation).

* cited by examiner

*Primary Examiner* — Minh D A
(74) *Attorney, Agent, or Firm* — Maschoff Brennan

(57) ABSTRACT

A light source driving device includes a light source unit, a driving unit, a voltage converting unit, a detecting unit, and a feed-back control unit. The driving unit is used to receive an input signal, and convert the input signal to a driving signal for output according to an enable signal and a feed-back signal. The voltage converting unit is used to convert the driving signal to a driving voltage, so as to output the driving voltage to a first end of the light source unit. The detecting unit is coupled to a second end of the light source unit, and used to detect an output current of the light source unit, so as to generate a detecting voltage. The feed-back control unit generates the feed-back signal according to the detecting voltage and a pulse width modulation signal.

11 Claims, 7 Drawing Sheets

LIGHT SOURCE DRIVING DEVICE

CROSS-REFERENCE TO RELATED APPLICATIONS

This non-provisional application claims priority under 35 U.S.C. §119(a) on Patent Application No(s). 100138270 filed in Taiwan, R.O.C. on Oct. 21, 2011, the entire contents of which are hereby incorporated by reference.

BACKGROUND

1. Technical Field

The present disclosure relates to a light source driving device, and more particularly to a light source driving device having a high-frequency light dimming function.

2. Related Art

Since light emitting diodes (LEDs) are small, power saving and durable and since the manufacturing technique of the LED becomes mature, products using the LEDs as a light source has gained in popularity.

Generally speaking, the LEDs may be driven by driving circuits such as, a chip with a model of MP-2370 or MP-2483, for generating light. Under a fixed current mode, the driving circuit performs on-off control with a switch frequency of approximately 1.6 MHz, so as to give power to the LED, and keep the brightness of the light generated by the LED stable.

However, in a light dimming mode, the driving circuit uses a light dimming signal of a square wave having a frequency of approximately 100 Hz-2 kHz. Next, the driving circuit performs on-off control on the power source required by the LED according to the duty cycle of the square wave, so as to perform a light dimming function on the LED. However, in the light dimming mode, since the original switch frequency of 1.6 MHz in the driving circuit is reduced to 100 Hz-2 KHz, the flickering the LED may be sampled by an image sensor (for example, 1/120 second and 1/240 second under short exposure), so that pictures captured by the image sensor may also flicker.

SUMMARY

The present disclosure provides a light source driving device, which comprises a light source unit, a driving unit, a voltage converting unit, a detecting unit, and a feed-back control unit. The driving unit is used to receive an input signal, and convert the input signal to a driving signal for output according to an enable signal and a feed-back signal. The voltage converting unit is coupled to the driving unit and a first end of the light source unit, used to receive the driving signal, and convert the driving signal to a driving voltage, so as to output the driving voltage to the first end of the light source unit. The detecting unit is coupled to a second end of the light source unit, and used to detect an output current of the light source unit, so as to generate a detecting voltage. The feed-back control unit is coupled to the detecting unit and the driving unit, used to receive the detecting voltage and a pulse width modulation signal, so as to generate the feed-back signal according to the detecting voltage and the pulse width modulation signal.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

In view of the above problems, some embodiments of the present disclosure are a light source driving device, capable of performing light dimming on a light source unit (for example, an LED) under a relatively high switch frequency, so that pictures captured by an image sensor do not have flickers.

Figure 1:
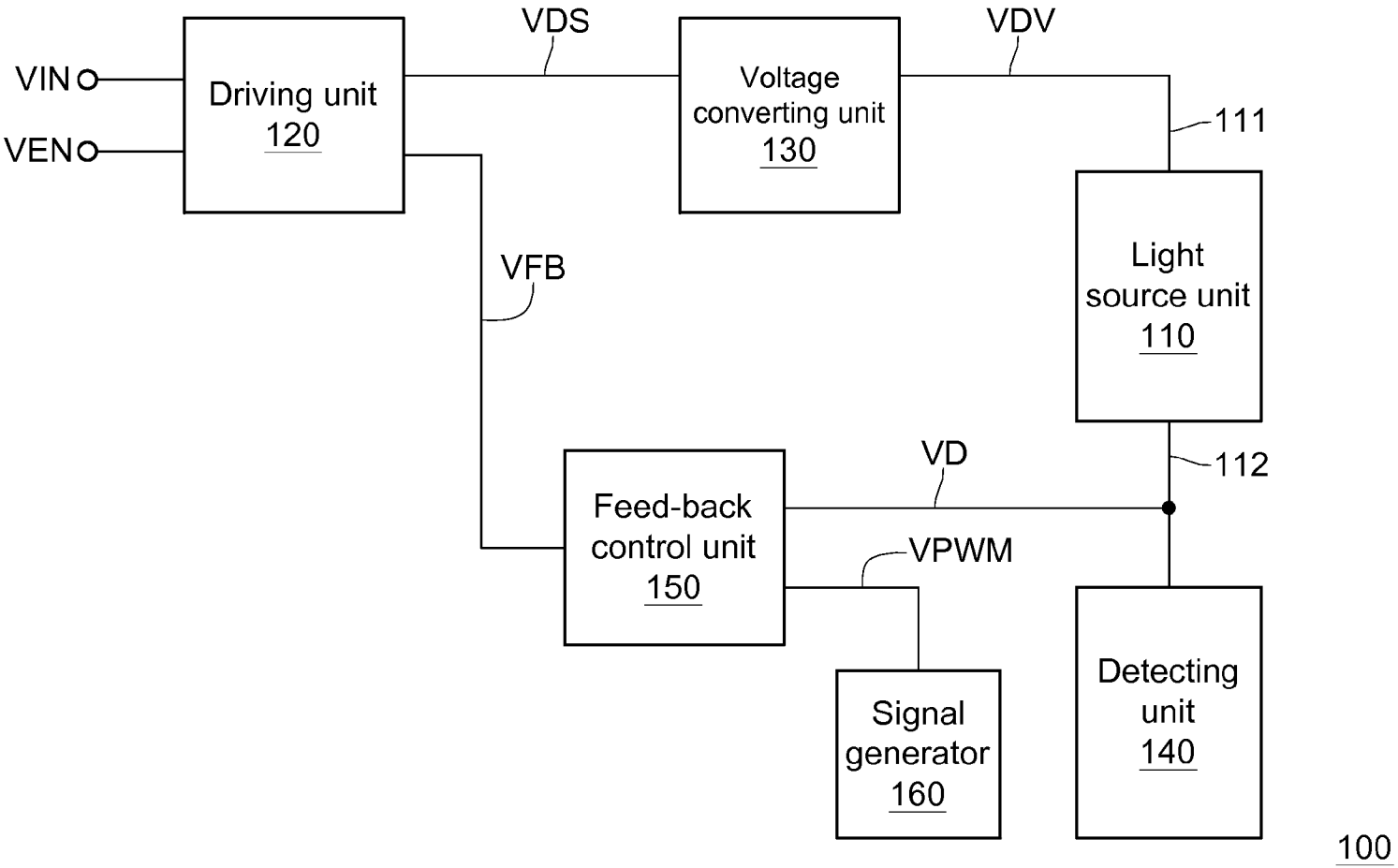
FIG. 1 is a block diagram of a light source driving device according to a first embodiment of the present disclosure.

FIG. 1 is a block diagram of a light source driving device according to a first embodiment of the present disclosure. Referring to FIG. 1, the light source driving device 100 comprises a light source unit 110, a driving unit 120, a voltage converting unit 130, a detecting unit 140, a feed-back control unit 150, and a signal generator 160. The light source unit 110 has a first end 111 and a second end 112. The driving unit 120 receives an input signal VIN, and converts the input signal VIN to a driving signal VDS for output according to an enable signal VEN and a feed-back signal VFB. That is to say, the driving unit 120 operates according to the enable signal VEN, and switches based on an frequency of the feed-back signal VFB, so as to convert the input signal VIN to the driving signal VDS used for driving the light source unit 110.

The voltage converting unit 130 is coupled to the driving unit 120 and the first end 111 of the light source unit 110 for receiving and then converting the driving signal VDS to a driving voltage VDV which is then output to the first end 111 of the light source unit 110. The detecting unit 140 is coupled to the second end 112 of the light source unit 110 for detecting an output current of the light source unit 110 and then generating a detecting voltage VD. The feed-back control unit 150 is coupled to the detecting unit 140 and the driving unit 120 for receiving the detecting voltage VD and a pulse width modulation signal VPWM and then generating the feed-back signal VFB according to the detecting voltage VD and the pulse width modulation signal VPWM. The signal generator 160 generating the pulse width modulation signal VPWM is coupled to the feed-back control unit 150.

In addition, in this embodiment, the pulse width modulation signal VPWM and the detecting voltage VD may be processed by the feed-back control unit 150, so that the feed-back signal VFB may have a corresponding relation between a duty cycle of the pulse width modulation signal VPWM and a brightness of the light source unit 110 for performing a light dimming function on the light source unit 110. Further, the frequency of the feed-back signal VFB is determined by the pulse width modulation signal VPWM. That is to say, the frequency of the pulse width modulation signal VPWM may be set to be relatively high, for example, 20 KHz, so that the frequency of the feed-back signal VFB may be the same as the frequency of the pulse width modulation signal VPWM for performing the light dimming of the light source unit 110. In this manner, the light source driving device 100 of this embodiment may perform the light dimming under the relatively high frequency, so that an image sensor will not sample the flickers of the light source unit 110.

Figure 2:
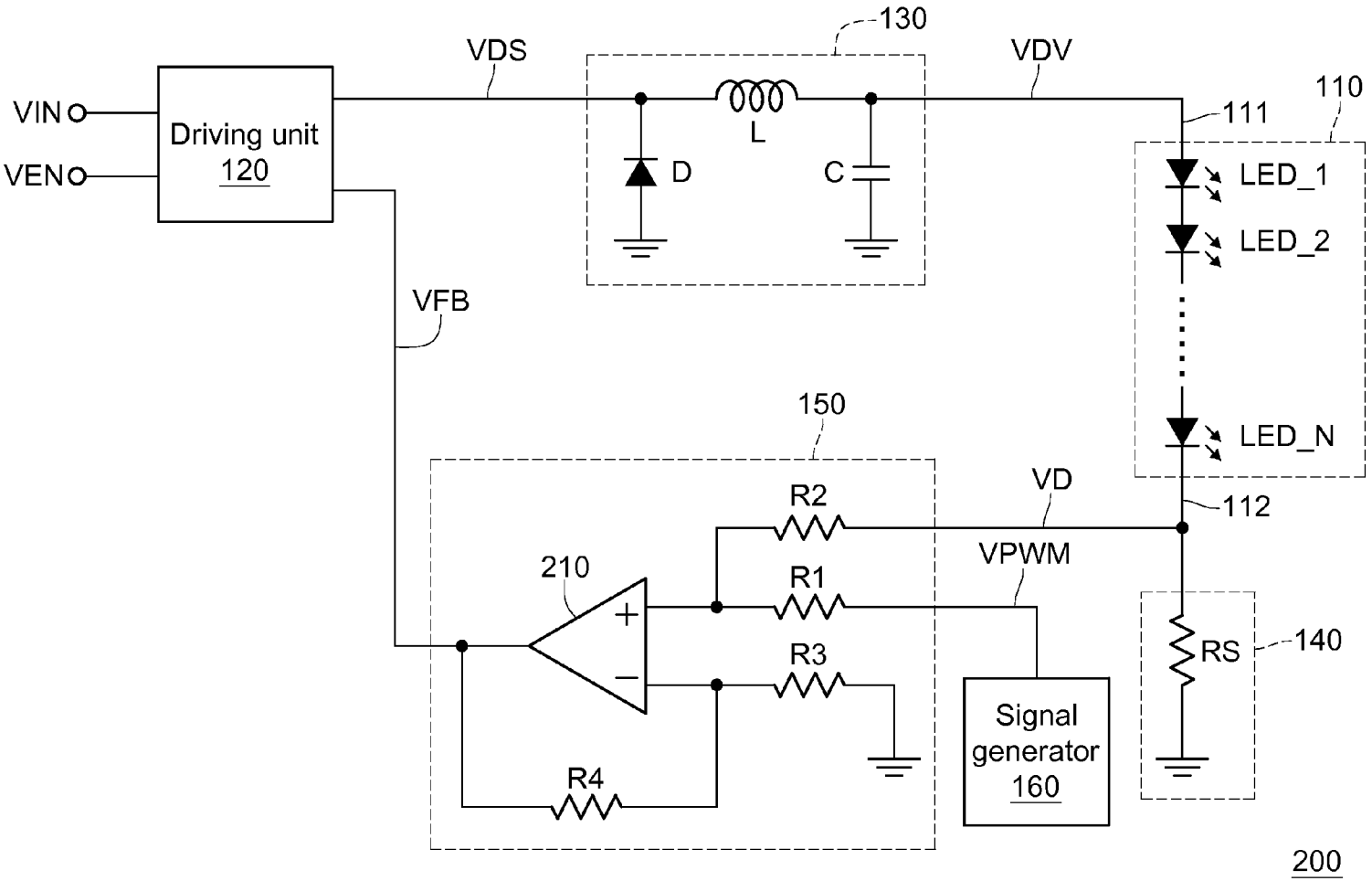
FIG. 2 is a schematic circuit diagram of a light source driving device according to a second embodiment of the present disclosure.

FIG. 2 is a schematic circuit diagram of a light source driving device according to a second embodiment of the present disclosure. Referring to FIG. 2, the light source driving device 200, similar to light source driving device in FIG. 1, comprises a light source unit 110, a driving unit 120, a voltage converting unit 130, a detecting unit 140, a feed-back control unit 150, and a signal generator 160. Coupling relations and operating manners of the elements may be obtained with reference to the description of the embodiment of FIG. 1, and are omitted here.

In this embodiment, the light source unit 110 comprises a plurality of LEDs LED_1-LED_N, in which N is a positive integer greater than 1. The anode end of the first LED LED_1 is the first end 111 of the light source unit 110, the cathode end of the last LED LED_N is the second end 112 of the light source unit 110, and anode ends and cathode ends of the remaining LEDs LED_2-LED_N−1 are coupled to each other. In another embodiment, the light source unit 110 may only consists of one LED LED_1 where the anode end of the LED LED_1 is the first end 111 of the light source unit 110, and the cathode end of the LED LED_1 is the second end 112 of the light source unit 110. That is to say, the light source driving device 200 of this embodiment is able to drive one LED or a plurality of LEDs to generate stable light.

The voltage converting unit 130 comprises an inductor L, a diode D, and a capacitor C. A first end of the inductor L is configured to receive a driving signal VDS, and a second end of the inductor L is coupled to the first end 111 of the light source unit 110. An anode end of the diode D is coupled to a ground terminal, and a cathode end of the diode D is coupled to the first end of the inductor L. A first end of the capacitor C is coupled to the second end of the inductor L, and a second end of the capacitor C is coupled to the ground terminal.

The detecting unit 140 comprises a resistor RS. A first end of the resistor RS is coupled to the second end 112 of the light source unit 110, and a second end of the resistor RS is coupled to the ground terminal. That is to say, after a current generated by the light source unit 110 flows through the resistor RS, the resistor RS generates the detecting voltage VD (that is, a voltage drop on the resistor RS).

The feed-back control unit 150 comprises resistors R1-R4 and an operational amplifier 210. A first end of the resistor R1 receives a pulse width modulation signal VPWM. A first end of the resistor R2 receives the detecting voltage VD, and a second end of the resistor R2 is coupled to a second end of the resistor R1. A first input end (for example, a positive input end) of the operational amplifier 210 is coupled to the second end of the resistor R2, and an output end of the operational amplifier 210 generates a feed-back signal VFB. A first end of the resistor R3 is coupled to a second input end (for example, a negative input end) of the operational amplifier 210, and a second end of the resistor R3 is coupled to the ground terminal. A first end of the resistor R4 is coupled to the first end of the resistor R3, and a second end of the resistor R4 is coupled to the output end of the operational amplifier 210. The combination of the resistors R1-R4 and the operational amplifier 210 may be considered as an adder, and resistance values of the resistors R1-R4 are the same, so that the feed-back signal VFB is equal to the sum of the pulse width modulation signal VPWM and the detecting voltage VD, that is, VFB=VPWM+VD.

For example, when the pulse width modulation signal VPWM equals 0 V, the feed-back signal VFB is the detecting voltage VD (that is, the voltage drop generated after the current output from the light source unit 110 flows through the resistor RS), which represents that the current output from the light source unit 110 is the maximum. When the voltage of the pulse width modulation signal VPWM equals the detecting voltage VD, it represents that the current flowing through the LED is the minimum. Therefore, by setting the detecting voltage VD to be the maximum voltage of the pulse width modulation signal VPWM, the feed-back signal VFB has the corresponding relation between the duty cycle of the pulse width modulation signal VPWM and the brightness of the light source unit 110 (that is, the magnitude of the detecting voltage VD). The corresponding relation is described in the following.

When the duty cycle of the pulse width modulation signal VPWM is 0%, the brightness of the light source unit 110 is 100% (that is, the detecting voltage VD is larger); when the duty cycle of the pulse width modulation signal VPWM is 10%, the brightness of the light source unit 110 is 90%; when the duty cycle of the pulse width modulation signal VPWM is 20%, the brightness of the light source unit 110 is 80%; . . . ; when the duty cycle of the pulse width modulation signal VPWM is 90%, the brightness of the light source unit 110 is 10%; and when the duty cycle of the pulse width modulation signal VPWM is 100%, the brightness of the light source unit 110 is 0% (that is, the detecting voltage VD is smaller).

In addition, when the light source driving device 200 performs the light dimming function, the frequency of the feed-back signal VFB may be determined by a frequency of the pulse width modulation signal VPWM. That is to say, a user may set the frequency of the pulse width modulation signal VPWM to be relatively high, for example, 20 KHz, so that the frequency of the feed-back signal VFB may be the same as the frequency of the pulse width modulation signal VPWM for performing the light dimming of the light source unit 110 (LEDs LED_1-LED_N). In this manner, the light source driving device 200 of this embodiment may perform the light dimming under the relatively high frequency, so that an image sensor may not sample the flickers of the light source unit 110.

Figure 3:
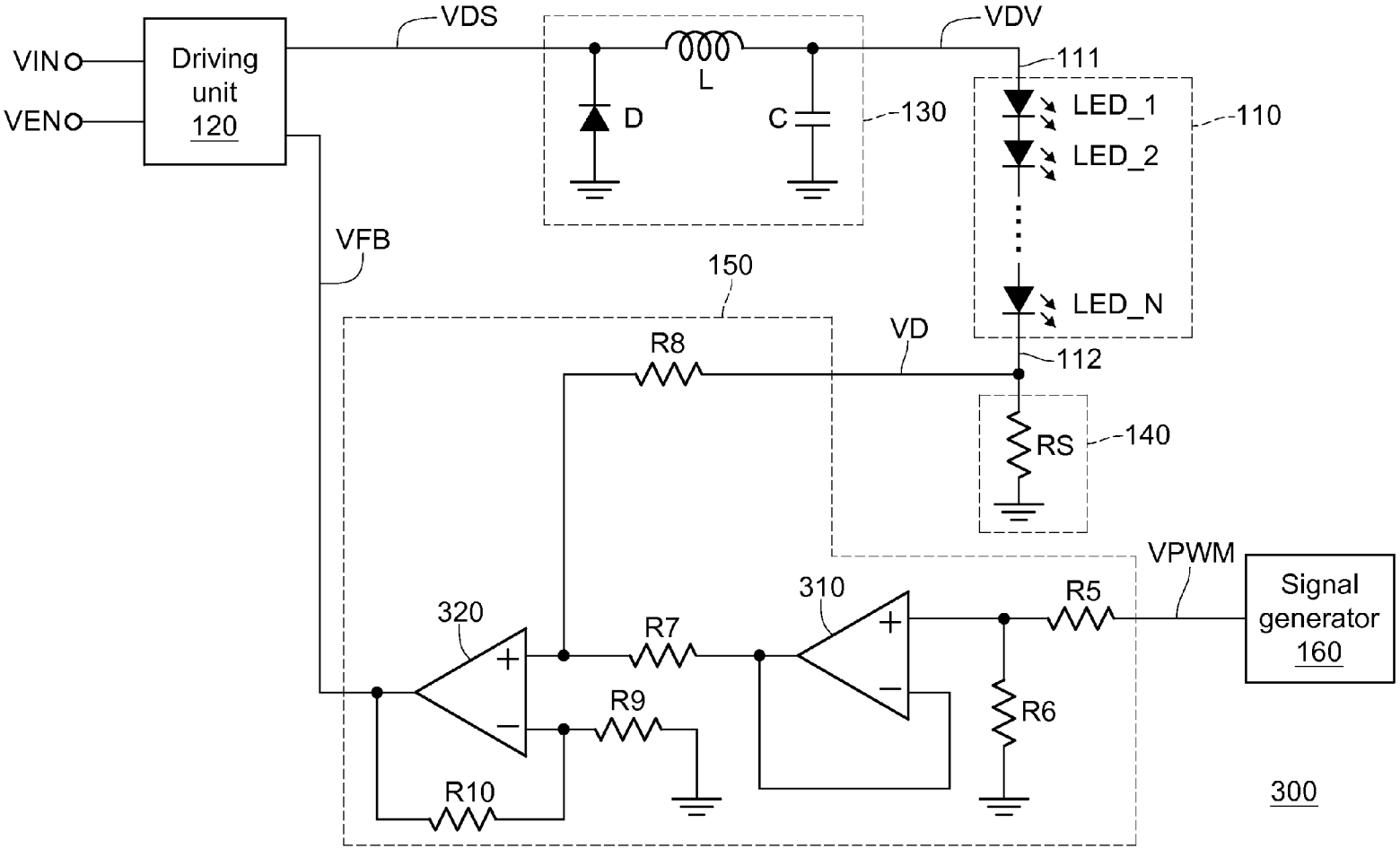
FIG. 3 is a schematic circuit diagram of a light source driving device according to a third embodiment of the present disclosure.

FIG. 3 is a schematic circuit diagram of a light source driving device according to a third embodiment of the present disclosure. Referring to FIG. 3, the light source driving device 300 comprises a light source unit 110, a driving unit 120, a voltage converting unit 130, a detecting unit 140, a feed-back control unit 150, and a signal generator 160 being the same as that in FIG. 1. Coupling relations and operating manners of the elements may be obtained with reference to the description of the embodiment of FIG. 1, and are omitted here.

The feed-back control unit 150 comprises resistors R5-R10 and operational amplifiers 310, 320. A first end of the resistor R5 receives a pulse width modulation signal VPWM. A first end of the resistor R6 is coupled to a second end of the resistor R5, and a second end of the resistor R6 is coupled to a ground terminal. A first input end (for example, a positive input end) of the operational amplifier 310 is coupled to the first end of the resistor R6, and a second input end (for example, a negative input end) and an output end of the operational amplifier 310 are coupled to each other.

A first end of the resistor R7 is coupled to the output end of the operational amplifier 310. A first end of the resistor R8 receives a detecting voltage VD, and a second end of the resistor R8 is coupled to a second end of the resistor R7. A first input end (for example, a positive input end) of the operational amplifier 320 is coupled to the second end of the resistor R8, and an output end of the operational amplifier 320 generates a feed-back signal VFB. A first end of the resistor R9 is coupled to a second input end (for example, a negative input end) of the operational amplifier 320, and a second end of the resistor R9 is coupled to the ground terminal. A first end of the resistor R10 is coupled to the first end of the resistor R9, and a second end is coupled to the output end of the operational amplifier 320.

The combination of the resistors R5-R6 and the operational amplifier 310 may be considered as a divider, and the combination of the resistors R7-R10 and the operational amplifier 320 may be considered as an adder. When a voltage level of the pulse width modulation signal VPWM is greater than a threshold of the feed-back signal VFB, the divider is able to divide the voltage level of the pulse width modulation signal VPWM to be the same as the feed-back signal VFB, and an output of the divider may be represented as VPWM_D=R6*VPWM/(R5+R6).

A user may adjust resistance values of the resistors R5 and R6, so that the pulse width modulation signal VPWM is the same as the feed-back signal VFB. In addition, the user set that resistance values of the resistors R7-R10 are the same. Next, the adder adds the detecting voltage VD to VPWM_D, that is, VFB=VD+VPWM_D. A manner for adjusting the light source of this embodiment may be obtained with reference to description of the second embodiment, and is omitted here.

Figure 4:
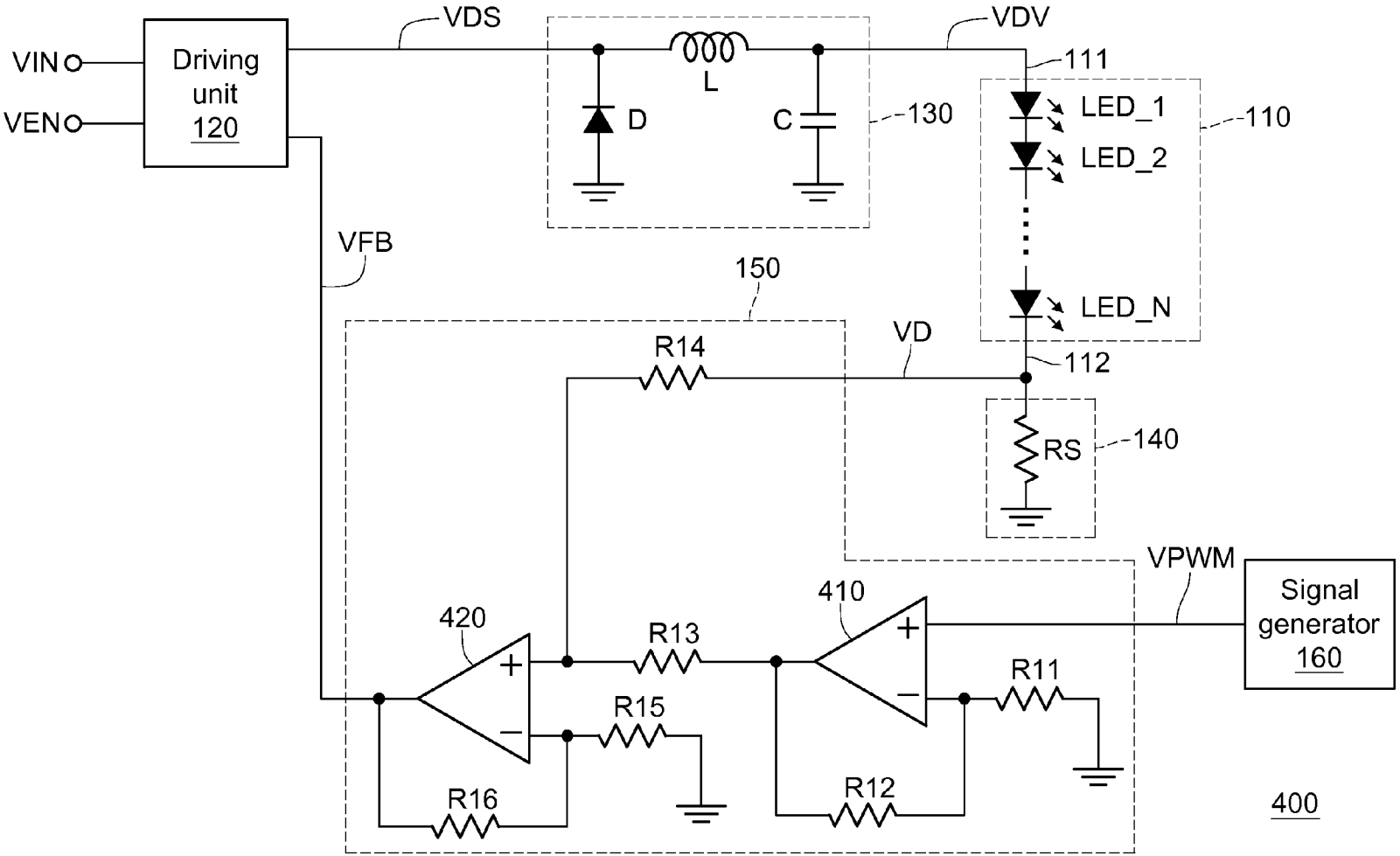
FIG. 4 is a schematic circuit diagram of a light source driving device according to a fourth embodiment of the present disclosure.

FIG. 4 is a schematic circuit diagram of a light source driving device according to a fourth embodiment of the present disclosure. Referring to FIG. 4, the light source driving device 400 comprises a light source unit 110, a driving unit 120, a voltage converting unit 130, a detecting unit 140, a feed-back control unit 150, and a signal generator 160 being the same as that in FIG. 1. Coupling relations and operating manners of the elements may be obtained with reference to the description of the embodiment of FIG. 1, and are omitted here.

The feed-back control unit comprises operational amplifiers 410, 420 and resistors R11-16. A first input end (for example, a positive input end) of the operational amplifier 410 receives a pulse width modulation signal VPWM. A first end of the resistor R11 is coupled to a second input end (for example, a negative input end) of the operational amplifier 410, and a second end of the resistor R11 is coupled to a ground terminal. A first end of the resistor R12 is coupled to the first end of the resistor R11, and a second end of the resistor R12 is coupled to an output end of the operational amplifier 410. A first end of the resistor R13 is coupled to the output end of the operational amplifier 410.

A first end of the resistor R14 receives a detecting voltage VD, and a second end of the resistor R14 is coupled to a second end of the resistor R13. A first input end (for example, a positive input end) of the operational amplifier 420 is coupled to the second end of the resistor R14, and an output end of the operational amplifier 420 generates a feed-back signal VFB. A first end of the resistor R15 is coupled to a second input end (for example, a negative input end) of the operational amplifier 420, and a second end of the resistor R15 is coupled to the ground terminal. A first end of the resistor R16 is coupled to the first end of the resistor R15, and a second end of the resistor R16 is coupled to the output end of the operational amplifier 420.

The combination of the operational amplifier 410 and the resistors R11-R12 may be considered as a multiplier, and the combination of the operational amplifier 420 and the resistors R13-R16 may be considered as an adder. When a voltage level of the pulse width modulation signal VPWM is smaller than a threshold of the feed-back signal VFB, the multiplier multiplies the voltage level of the pulse width modulation signal VPWM to be the same as the feed-back signal VFB. In addition, the output of the multiplier may be represented as VPWM_M=(R11+R12)*VPWM/R11.

A user may adjust resistance values of the resistors R11 and R12, so that the pulse width modulation signal VPWM may be the same as the feed-back signal VFB. In addition, the user may set that resistance values of the resistors R13-R16 are the same. Next, the adder adds the detecting voltage VD to VPWM_M, that is, VFB=VD+VPWM_M. The manner for adjusting the light source of this embodiment may be obtained with reference to description of the second embodiment, and is omitted here.

Figure 5:
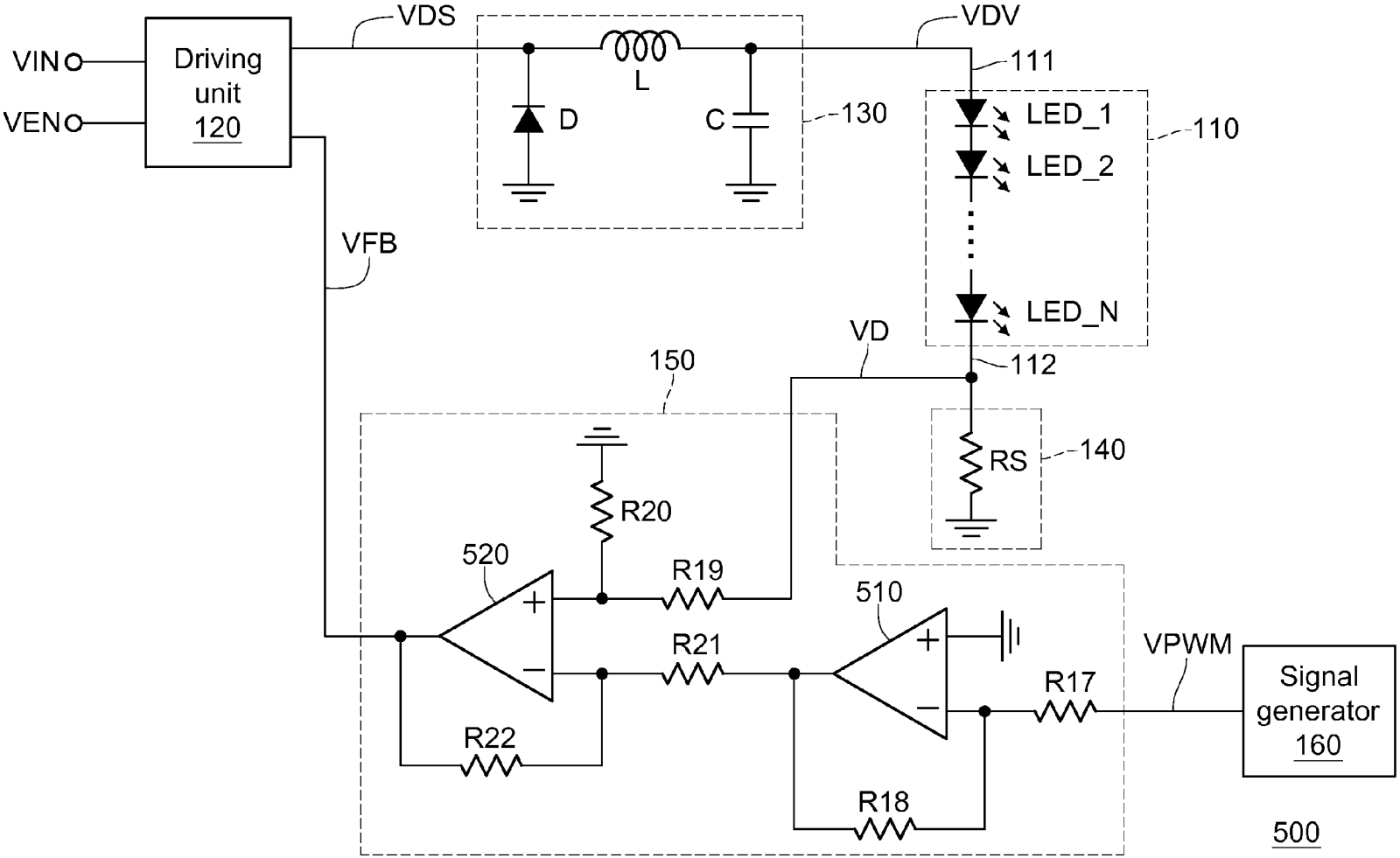
FIG. 5 is a schematic circuit diagram of a light source driving device according to a fifth embodiment of the present disclosure.

FIG. 5 is a schematic circuit diagram of a light source driving device according to a fifth embodiment of the present disclosure. Referring to FIG. 5, the light source driving device 500 comprises a light source unit 110, a driving unit 120, a voltage converting unit 130, a detecting unit 140, a feed-back control unit 150, and a signal generator 160 being the same as that in FIG. 1. Coupling relations and operating manners of the elements may be obtained with reference to the description of the embodiment of FIG. 1, and are omitted here.

The feed-back control unit 150 comprises resistors R17-R22 and operational amplifiers 510, 520. A first end of the resistor R17 receives a pulse width modulation signal VPWM. A first input end (for example, a positive input end) of the operational amplifier 510 is coupled to a ground terminal, and a second input end of the operational amplifier 510 is coupled to a second end of the resistor R17. A first end of the resistor R18 is coupled to the second input end (for example, a negative input end) of the operational amplifier 510, and a second end of the resistor R18 is coupled to an output end of the operational amplifier 510.

A first end of the resistor R19 receives a detecting voltage VD. A first end of the resistor R20 is coupled to a second end of the resistor R19, and a second end of the resistor R20 is coupled to the ground terminal. A first end of the resistor R21 is coupled to the output end of the operational amplifier 510. A first input end (for example, a positive input end) of the operational amplifier 520 is coupled to the first end of the resistor R21, a second input end (for example, a negative input end) of the operational amplifier 520 is coupled to a second end of the resistor R21, and an output end of the operational amplifier 520 generates a feed-back signal VFB. A first end of the resistor R22 is coupled to the second input end of the operational amplifier 520, and a second end of the resistor R22 is coupled to the output end of the operational amplifier 520.

The combination of the resistors R17-R22 and the operational amplifiers 510, 520 may be considered as a subtracter, and resistance values of the resistors R17-R22 are the same, so that the feed-back signal VFB is equal to the detecting voltage VD the minus negative pulse width modulation signal VPWM, that is, VFB=VD−(−VPWM)=VD+VPWM. A manner for adjusting the light source of this embodiment may be obtained with reference to description of the second embodiment, and is omitted here.

Figure 6:
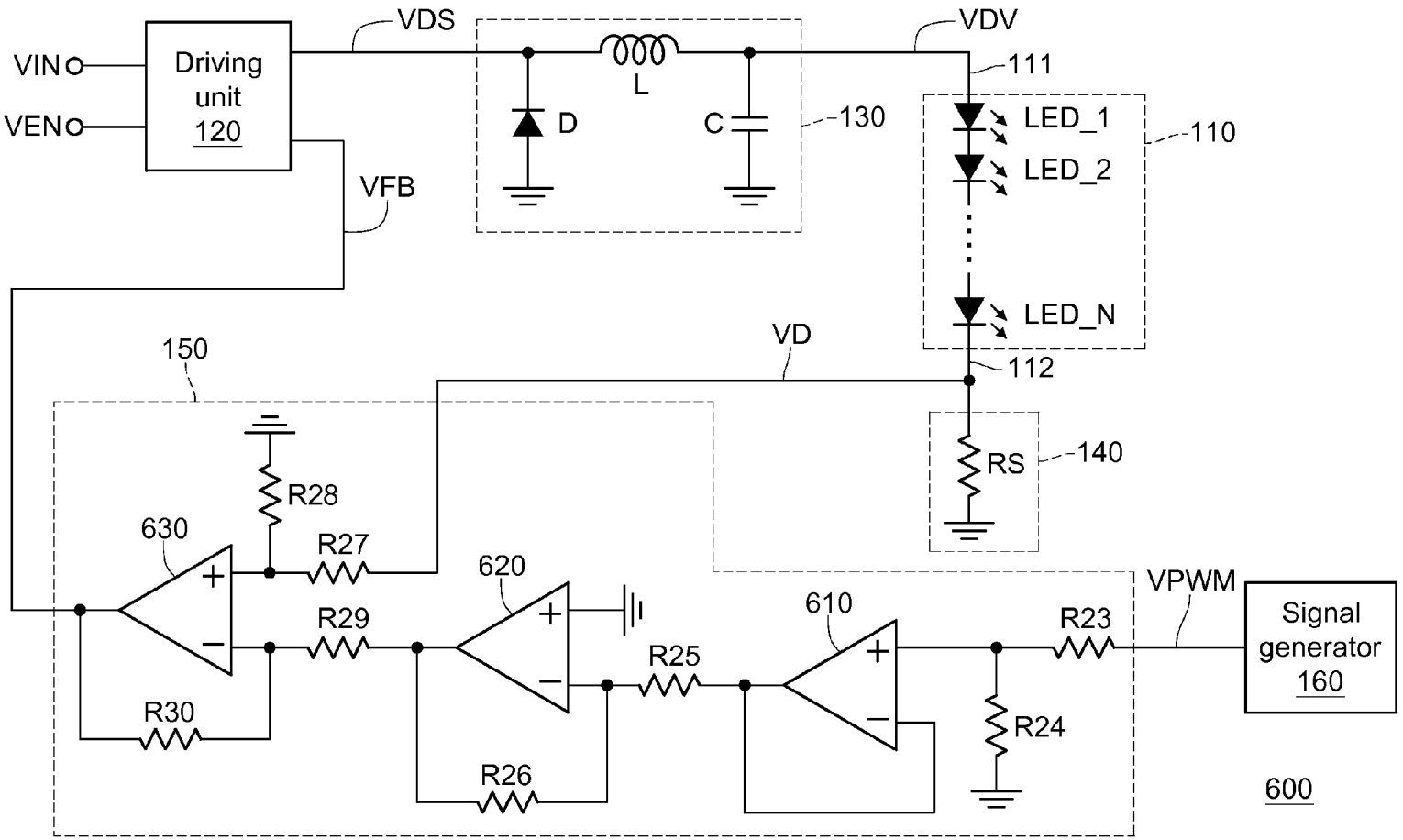
FIG. 6 is a schematic circuit diagram of a light source driving device according to a sixth embodiment of the present disclosure.

FIG. 6 is a schematic circuit diagram of a light source driving device according to a sixth embodiment of the present disclosure. Referring to FIG. 6, the light source driving device 600 comprises a light source unit 110, a driving unit 120, a voltage converting unit 130, a detecting unit 140, a feed-back control unit 150, and a signal generator 160 being the same as that in FIG. 1. Coupling relations and operating manners of the elements may be obtained with reference to the description of the embodiment of FIG. 1, and are omitted here.

The feed-back control unit 150 comprises resistors R23-R30 and operational amplifiers 610, 620, 630. A first end of the resistor R23 receives a pulse width modulation signal VPWM. A first end of the resistor R24 is coupled to a second end of the resistor R23, and a second end of the resistor R24 is coupled to a ground terminal. A first input end (for example, a positive input end) of the operational amplifier 610 is coupled to the first end of the resistor R24, and a second input end (for example, a negative input end) and an output end of the operational amplifier 610 are coupled to each other.

A first end of the resistor R25 is coupled to the output end of the operational amplifier 610. A first input end (for example, a positive input end) of the operational amplifier 620 is coupled to the ground terminal, and a second input end (for example, a negative input end) of the operational amplifier 620 is coupled to a second end of the resistor R25. A first end of the resistor R26 is coupled to the second input end of the operational amplifier 620, and a second end of the resistor R26 is coupled to the output end of the operational amplifier 620.

A first end of the resistor R27 receives a detecting voltage VD. A first end of the resistor R28 is coupled to a second end of the resistor R27, and a second end of the resistor R28 is coupled to the ground terminal. A first end of the resistor R29 is coupled to the output end of the operational amplifier 620. A first input end (for example, a positive input end) of the operational amplifier 630 is coupled to the first end of the resistor R28, a second input end (for example, a negative input end) of the operational amplifier 630 is coupled to a second end of the resistor R29, and an output end of the operational amplifier 630 generates a feed-back signal VFB. A first end of the resistor R30 is coupled to the second input end of the operational amplifier 630, and a second end of the resistor R30 is coupled to the output end of the operational amplifier 630.

The combination of the operational amplifier 610 and the resistors R23-R24 may be considered as a divider, and the combination of the operational amplifiers 620, 630 and the resistors R25-R30 may be considered as a subtracter. When a voltage level of the pulse width modulation signal VPWM is greater than a threshold of the feed-back signal VFB, the divider divides the voltage level of the pulse width modulation signal VPWM to be the same as the feed-back signal VFB, and an output of the divider may be represented as VPWM_D=R24*VPWM/(R23+R24).

A user may adjust resistance values of the resistors R23 and R24, so that the pulse width modulation signal VPWM may be the same as the feed-back signal VFB. In addition, the user may make resistance values of the resistors R25-R30 be the same. Next, the subtracter subtracts the negative VPWM_D from the detecting voltage VD, that is, VFB=VD−(−VPWM) =VD+VPWM_D. A manner for adjusting the light source of this embodiment may be obtained with reference to description of the second embodiment, and is omitted here.

Figure 7:
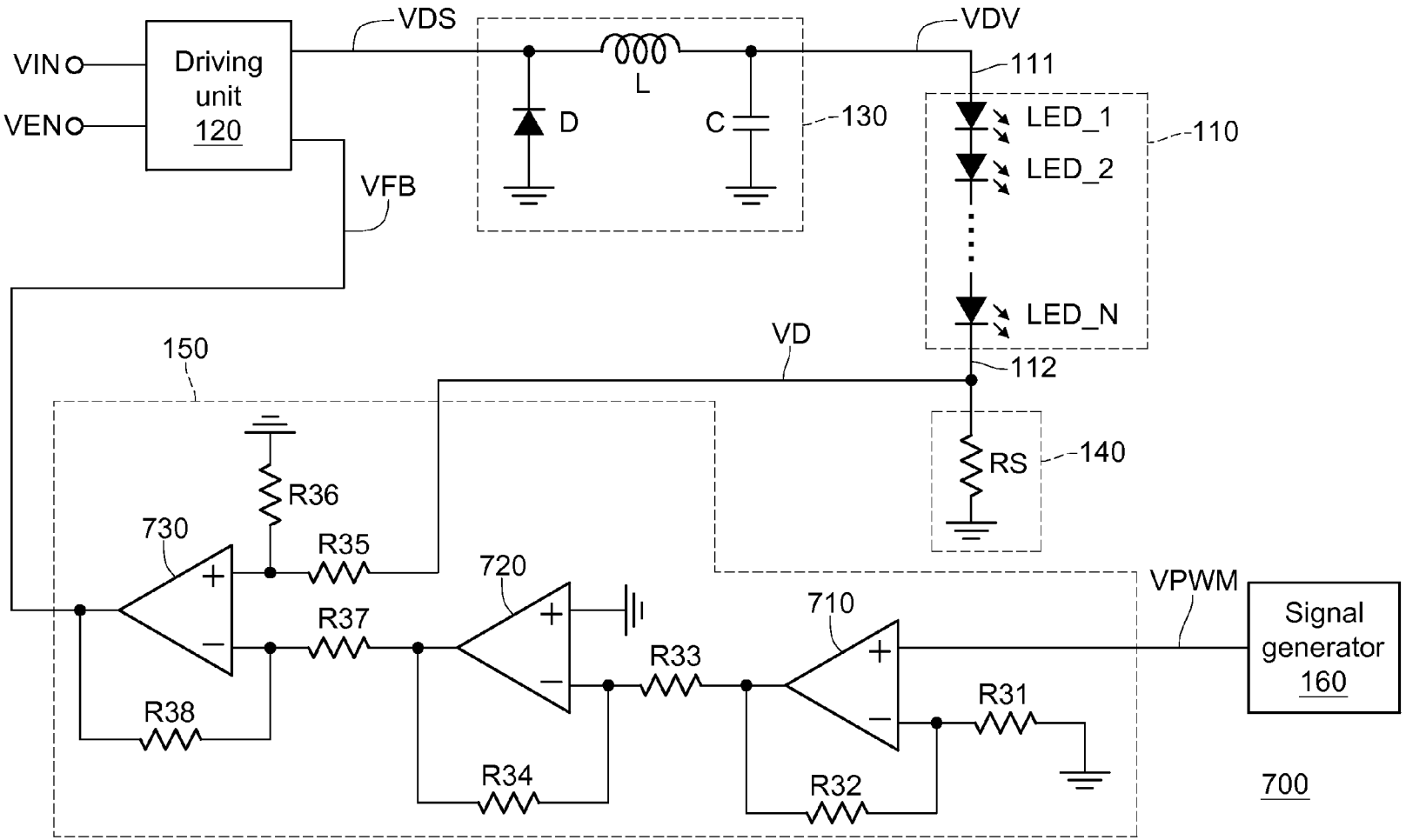
FIG. 7 is a schematic circuit diagram of a light source driving device according to a seventh embodiment of the present disclosure.

FIG. 7 is a schematic circuit diagram of a light source driving device according to a seventh embodiment of the present disclosure. Referring to FIG. 7, the light source driving device 700 comprises a light source unit 110, a driving unit 120, a voltage converting unit 130, a detecting unit 140, a feed-back control unit 150, and a signal generator 160 being the same as that in FIG. 1. Coupling relations and operating manners of the elements may be obtained with reference to description of the embodiment of FIG. 1, and are omitted here.

The feed-back control unit 150 comprises operational amplifiers 710, 720, 730 and resistors R31-R38. A first input end (for example, a positive input end) of the operational amplifier 710 receive pulses a width modulation signal VPWM. A first end of the resistor R31 is coupled to a second input end (for example, a negative input end) of the operational amplifier 710, and a second end of the resistor R31 is coupled to a ground terminal. A first end of the resistor R32 is coupled to the first end of the resistor R31, and a second end of the resistor R32 is coupled to an output end of the operational amplifier 710.

A first end of the resistor R33 is coupled to the output end of the operational amplifier 710. A first input end (for example, a positive input end) of the operational amplifier 720 is coupled to the ground terminal, and a second input end (for example, a negative input end) of the operational amplifier 720 is coupled to a second end of the resistor R33. A first end of the resistor R34 is coupled to the second input end of the operational amplifier 720, and a second end of the resistor R34 is coupled to an output end of the operational amplifier 720.

A first end of the resistor R35 receives a detecting voltage. A first end of the resistor R36 is coupled to a second end of the resistor R35, and a second end of the resistor R36 is coupled to the ground terminal. A first end of the resistor R37 is coupled to the output end of the operational amplifier 720. A first input end (for example, a positive input end) of the operational amplifier 730 is coupled to the first end of the resistor R36, a second input end (for example, a negative input end) of the operational amplifier 730 is a second end of the coupled to resistor R37, and an output end of the operational amplifier 730 generates a feed-back signal VFB. A first end of the resistor R38 is coupled to the second input end of the operational amplifier 730, and a second end of the resistor R38 is coupled to the output end of the operational amplifier 730.

The combination of the operational amplifier 710 and the resistors R31-R32 may be considered as a multiplier, and the combination of the operational amplifiers 720, 730 and the resistors R33-R38 may be considered as a subtracter. When a voltage level of the pulse width modulation signal VPWM is smaller than a threshold of the feed-back signal VFB, the multiplier multiplies the voltage level of the pulse width modulation signal VPWM to be the same as the feed-back signal VFB, and an output of the multiplier may be represented as VPWM_M=(R31+R32)*VPWM/R31.

A user may adjust resistance values of the resistors R31 and R32, so that the pulse width modulation signal VPWM may be the same as the feed-back signal VFB. In addition, the user may make resistance values of the resistors R33-R38 be the same. Next, the subtracter subtracts the negative VPWM_M from the detecting voltage VD, that is, VFB=VD−(−VPWM) =VD+VPWM_M. A manner for adjusting the light source of this embodiment may be obtained with reference to description of the second embodiment, and is omitted here.

In the light source driving device according to the embodiments of the present disclosure, the feed-back control unit processes the detecting voltage and the pulse width modulation signal to generate the feed-back signal, and the frequency of the feed-back signal is determined by the pulse width modulation signal, that is, the light dimming function is performed with the relatively high frequency, thereby effectively preventing the image sensor from sampling the flickers of the light source unit.

What is claimed is:

1. A light source driving device, comprising:

a light source unit, comprising a first end and a second end;

a driving unit, configured to receive an input signal, and convert the input signal to a driving signal for output according to an enable signal and a feed-back signal;

a voltage converting unit, coupled to the driving unit and the first end of the light source unit, the voltage converting unit configured to receive the driving signal, convert the driving signal to a driving voltage, and output the driving voltage to the first end of the light source unit;

a detecting unit, coupled to the second end of the light source unit, the detecting unit configured to detect an output current of the light source unit for generating a detecting voltage; and a feed-back control unit, coupled to the detecting unit and the driving unit, the feed-back control unit configured to receive the detecting voltage and a pulse width modulation signal for generating the feed-back signal according to the detecting voltage and the pulse width modulation signal, wherein the feed-back control unit comprises: a first resistor, comprising a first end for receiving the pulse width modulation signal; a second resistor, comprising a first end coupled to the detecting unit, and a second end coupled to a second end of the first resistor; a first operational amplifier, comprising a first input end coupled to the second end of the second resistor, and an output end for outputting the feed-back signal; a third resistor, comprising a first end coupled to a second input end of the first operational amplifier, and a second end coupled to a ground terminal; and a fourth resistor, comprising a first end coupled to the first end of the third resistor, and a second end coupled to the output end of the first operational amplifier.

2. The light source driving device according to claim 1, wherein the feed-back control unit comprises:

a fifth resistor, comprising a first end for receiving the pulse width modulation signal;

a sixth resistor, comprising a first end coupled to a second end of the fifth resistor, and a second end coupled to a ground terminal;

a second operational amplifier, comprising a first input end coupled to the first end of the sixth resistor, and a second input end and an output end coupled to each other;

a seventh resistor, comprising a first end coupled to the output end of the second operational amplifier;

an eighth resistor, comprising a first end for receiving the detecting voltage, and a second end coupled to a second end of the seventh resistor;

a third operational amplifier, comprising a first input end coupled to the second end of the eighth resistor, and an output end for outputting the feed-back signal;

a ninth resistor, comprising a first end coupled to a second input end of the third operational amplifier, and a second end coupled to the ground terminal; and a tenth resistor, comprising a first end coupled to the first end of the ninth resistor, and a second end coupled to the output end of the third operational amplifier.

3. The light source driving device according to claim 1, wherein the feed-back control unit comprises:

a fourth operational amplifier, comprising a first input end for receiving the pulse width modulation signal;

an eleventh resistor, comprising a first end coupled to a second input end of the fourth operational amplifier, and a second end coupled to a ground terminal;

a twelfth resistor, comprising a first end coupled to the first end of the eleventh resistor, and a second end coupled to an output end of the fourth operational amplifier;

a thirteenth resistor, comprising a first end coupled to the output end of the fourth operational amplifier;

a fourteenth resistor, comprising a first end for receiving the detecting voltage, and a second end coupled to a second end of the thirteenth resistor;

a fifth operational amplifier, comprising a first input end coupled to the second end of the fourteenth resistor, and an output end for generating the feed-back signal;

a fifteenth resistor, comprising a first end coupled to a second input end of the fifth operational amplifier, and a second end coupled to the ground terminal; and a sixteenth resistor, comprising a first end coupled to the first end of the fifteenth resistor, and a second end coupled to the output end of the fifth operational amplifier.

4. The light source driving device according to claim 1, wherein the feed-back control unit comprises:

a seventeenth resistor, comprising a first end for receiving the pulse width modulation signal;

a sixth operational amplifier, comprising a first input end coupled to a ground terminal, and a second input end coupled to a second end of the seventeenth resistor;

an eighteenth resistor, comprising a first end coupled to the second input end of the sixth operational amplifier, and a second end coupled to an output end of the sixth operational amplifier;

a nineteenth resistor, comprising a first end for receiving the detecting voltage;

a twentieth resistor, comprising a first end coupled to a second end of the nineteenth resistor, and a second end coupled to the ground terminal;

a twenty-first resistor, comprising a first end coupled to the output end of the sixth operational amplifier;

a seventh operational amplifier, comprising a first input end coupled to the first end of the twentieth resistor, a second input end coupled to a second end of the twenty-first resistor, and an output end for outputting the feed-back signal; and a twenty-second resistor, comprising a first end coupled to the second input end of the seventh operational amplifier, and a second end coupled to the output end of the seventh operational amplifier.

5. The light source driving device according to claim 1, wherein the feed-back control unit comprises:

a twenty-third resistor, comprising a first end for receiving the pulse width modulation signal;

a twenty-fourth resistor, comprising a first end coupled to a second end of the twenty-third resistor, and a second end coupled to a ground terminal;

an eighth operational amplifier, comprising a first input end coupled to the first end of the twenty-fourth resistor, and a second input end and an output end coupled to each other;

a twenty-fifth resistor, comprising a first end coupled to an output end of the eighth operational amplifier;

a ninth operational amplifier, comprising a first input end coupled to the ground terminal, and a second input end coupled to a second end of the twenty-fifth resistor;

a twenty-sixth resistor, comprising a first end coupled to the second input end of the ninth operational amplifier, and a second end coupled to an output end of the ninth operational amplifier;

a twenty-seventh resistor, comprising a first end for receiving the detecting voltage;

a twenty-eighth resistor, comprising a first end coupled to a second end of the twenty-seventh resistor, and a second end coupled to the ground terminal;

a twenty-ninth resistor, comprising a first end coupled to the output end of the ninth operational amplifier;

a tenth operational amplifier, comprising a first input end coupled to the first end of the twenty-eighth resistor, a second input end coupled to a second end of the twenty-ninth resistor, and an output end for outputting the feed-back signal; and a thirtieth resistor, comprising a first end coupled to the second input end of the tenth operational amplifier, and a second end coupled to the output end of the tenth operational amplifier.

6. The light source driving device according to claim 1, wherein the feed-back control unit comprises:

an eleventh operational amplifier, comprising a first input end for receiving the pulse width modulation signal;

a thirty-first resistor, comprising a first end coupled to a second input end of the eleventh operational amplifier, and a second end coupled to a ground terminal;

a thirty-second resistor, comprising a first end coupled to the first end of the thirty-first resistor, and a second end coupled to an output end of the eleventh operational amplifier;

a thirty-third resistor, comprising a first end coupled to an output end of the eleventh operational amplifier;

a twelfth operational amplifier, comprising a first input end coupled to the ground terminal, and a second input end coupled to a second end of the thirty-third resistor;

a thirty-fourth resistor, comprising a first end coupled to the second input end of the twelfth operational amplifier, and a second end coupled to an output end of the twelfth operational amplifier;

a thirty-fifth resistor, comprising a first end for receiving the detecting voltage;

a thirty-sixth resistor, comprising a first end coupled to a second end of the thirty-fifth resistor, and a second end coupled to the ground terminal;

a thirty-seventh resistor, comprising a first end coupled to the output end of the twelfth operational amplifier;

a thirteenth operational amplifier, comprising a first input end coupled to the first end of the thirty-sixth resistor, a second input end coupled to a second end of the thirty-seventh resistor, and an output end for outputting the feed-back signal; and a thirty-eighth resistor, comprising a first end coupled to the second input end of the thirteenth operational amplifier, and a second end coupled to the output end of the thirteenth operational amplifier.

7. The light source driving device according to claim 1, wherein the voltage converting unit comprises:

an inductor, comprising a first end for receiving the driving signal, and a second end coupled to the first end of the light source unit;

a diode, comprising an anode end coupled to a ground terminal, and a cathode end coupled to the first end of the inductor; and a capacitor, comprising a first end coupled to the second end of the inductor, and a second end coupled to the ground terminal.

8. The light source driving device according to claim 1, wherein the detecting unit comprises a resistor, comprising a first end coupled to the second end of the light source unit, and a second end coupled to a ground terminal.

9. The light source driving device according to claim 1, wherein the light source unit comprises a light emitting diode (LED), comprising an anode end being the first end of the light source unit, and a cathode end being the second end of the light source unit.

10. The light source driving device according to claim 1, wherein the light source unit comprises a plurality of LEDs, an anode end of a first LED is the first end of the light source unit, a cathode end of a last LED is the second end of the light source unit, and anode ends and cathode ends of the remaining LEDs are coupled to each other.

11. The light source driving device according to claim 1, further comprising:

a signal generator, coupled to the feed-back control unit, the signal generator configured to generate the pulse width modulation signal.

* * * * *